United States Patent [19]

Friedman

[11] Patent Number: 4,467,975

[45] Date of Patent: Aug. 28, 1984

[54] SLITTER APPARATUS

[75] Inventor: Morris Friedman, Warren, Ohio

[73] Assignee: United Steel Service, Inc., Brookfield, Ohio

[21] Appl. No.: 384,630

[22] Filed: Jun. 3, 1982

[51] Int. Cl.[3] ..... B65H 35/02

[52] U.S. Cl. ..... 242/564; 242/76

[58] Field of Search ..... 242/56.4, 58.3, 67.2, 242/75.2, 76, 68.4, 56.2, 56.5, 55.2, 57, 56.6, 56.7; 83/102, 425, 425.2, 425.3

[56] References Cited

U.S. PATENT DOCUMENTS

| | | | |
|---|---|---|---|
| 1,465,964 | 8/1923 | Cameron et al. | 242/56.5 |
| 2,095,019 | 10/1937 | Wood | 242/68.4 |
| 3,406,924 | 10/1968 | Bruns et al. | 242/56.4 |
| 3,433,429 | 3/1969 | Schnitzspahn | 242/56.4 X |
| 3,709,445 | 1/1973 | Adams | 242/55.2 |
| 3,997,095 | 12/1976 | Lamb | 242/75.2 X |
| 4,093,140 | 6/1978 | Matsunaga | 242/75.2 X |
| 4,153,216 | 5/1979 | Becker et al. | 242/56.4 X |
| 4,201,352 | 5/1980 | Madachy | 242/75.2 X |

*Primary Examiner*—Stuart S. Levy

*Assistant Examiner*—Scott J. Haugland

*Attorney, Agent, or Firm*—Harpman & Harpman

[57] ABSTRACT

The slitter apparatus herein disclosed provides means for holding the tail end of the scrap strips which are removed from the opposite side margins of a strip of steel in the usual slitting process. A pair of guide and clamp bodies are mounted for movement transverse to the line of movement of the scrap strips for alignment with the scrap as it issues from the slitter knives. Each of the bodies includes a pair of vertically-disposed rolls between which the scrap strip passes, the rolls guiding the scrap strip for alignment with a respective one of a pair of scrap winders. Each of the bodies also includes a horizontally-disposed roll round which the strip passes, this roll having a hardened steel surface and a brake shoe is associated with each roll and is adapted to clamp the scrap strip against the roll just before the tail end of the strip on the payoff reel passes the slitter knives. Thus, when the tail end of the scrap strip passes the slitter knives, it is held in position so that the leading end of scrap strip from a subsequent payoff reel may easily be clamped to the trailing end and stitch-welded thereto.

10 Claims, 5 Drawing Figures

X

SLITTER APPARATUS

BACKGROUND AND SUMMARY

In prior art slitting apparatus (insofar as applicant is aware) no means are provided to hold the tail end of scrap strip in position for easy attachment to the leading end of scrap strip from a subsequent coil of steel or other metal. Such tail end of the scrap strip thus dropped of its own accord and frequently became lodged in a very inaccessible location. Because the scrap strip is rather inflexible and sometimes has razor-like edges, handling thereof is difficult and hazardous and thoroughly disliked by the slitter operator.

Through use of my invention, the tail end of the scrap strip is held in a predetermined position so that the leading end of scrap strip from a subsequent steel coil may be easily attached to it, and welded thereto, with a minimum of handling.

DESCRIPTION OF THE DRAWINGS

In the drawings acompanying this specification and forming a part of this application there is shown, for purpose of illustration, an embodiment which my invention may assume, and in these drawings.

DESCRIPTION OF THE PREFERRED EMBODIMENT

Warehousing of steel is big business because a steel fabricator need not carry an inventory of strip in various widths, but may order from a warehouse a supply of strip of the exact width and the exact amount for a known order.

The warehouser, on the other hand, carries an inventory of wide coils which are slit to the size required by the fabricator. In a known form of slitting (and therefore not particularly illustrated herein) wide coils of strip are loaded into a ramp from which they are permitted to roll, as required, onto a charging buggy which moves the coils to the payoff reel of the slitting machine. The buggy is provided with an elevator by which it is possible to center the coil on the reel before the retaining bands on the coil are removed. Instead of the buggy, a traveling crane may be used to position the coil on the reel. The reel, which is motor driven, is rotated to slowly unwind the strip which is threaded into a set of breaker rolls that flatten it sufficiently to facilitate threading through pinch rolls and into the slitter knives. These knives, which may take the form of tool-steel discs, are mounted on arbors above and below the strip and are spaced with rings to slit to the desired width. From the slitter, the trimmed strip passes to the recoiler and is wound thereon. The narrow strips of scrap trimmed from the edges of the wide strip are wound on scrap winders. After the leading end of the strip has been threaded completely through the line, the recoiler and slitter motors are adjusted to pull the strip through the slitter knives with any desired tension.

Figure 1:
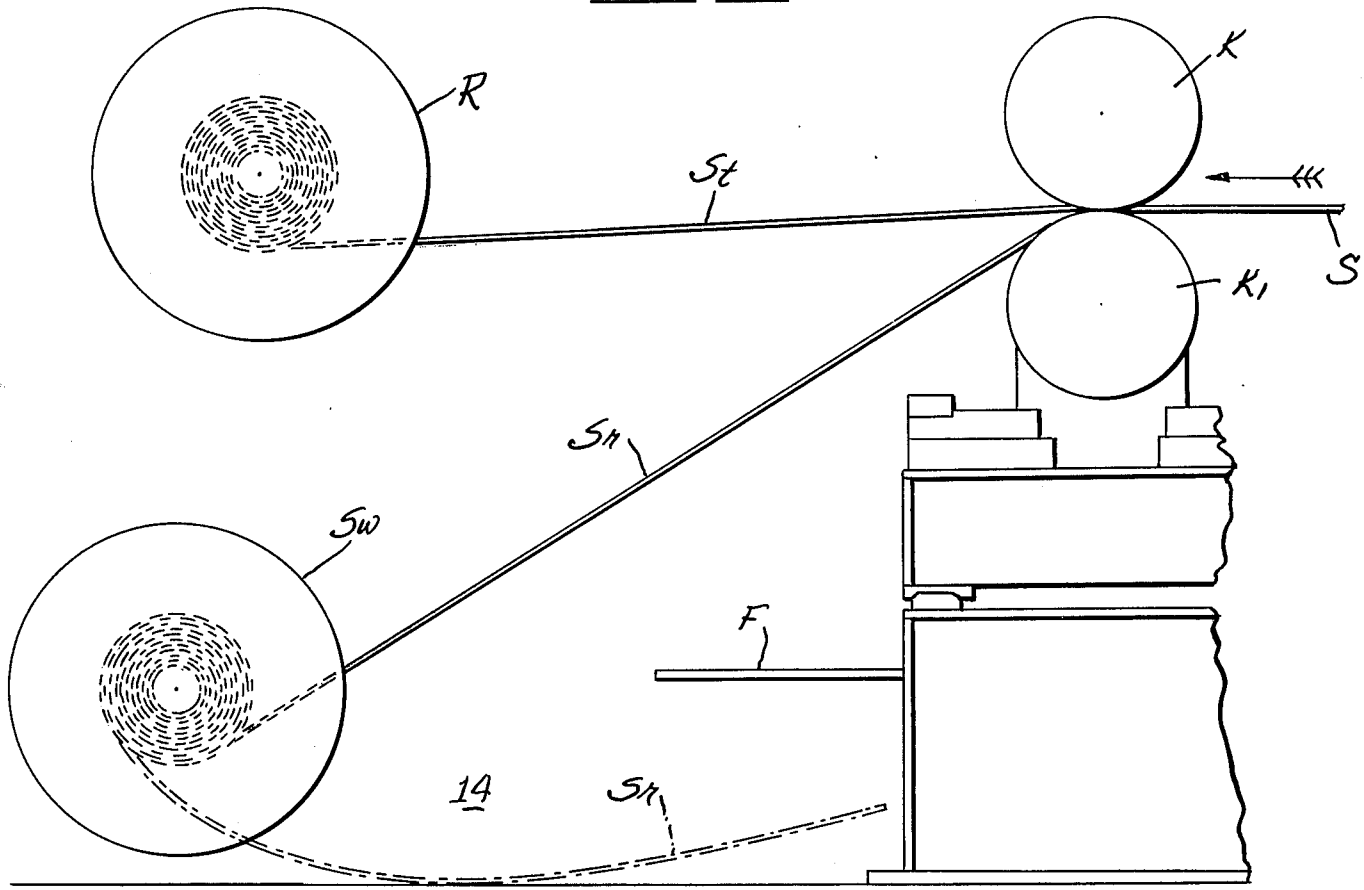
FIG. 1. PRIOR ART
FIG. 1 is a schematic side elevational representation of the prior art as known by applicant.

FIG. 1 discloses, in diagrammatic fashion, the slitter knives, K, Kl operating on the strip from a wide coil (not shown). The trimmed strip St is shown as being wound on the mandrel of a recoiler R of any known construction. The scrap strips Sr which have been slit from the opposite ends of the wide coil are shown being wound on respective scrap winders Sw. If the slit strip is not too wide, the scrap removed from both ends of the wide coil may be wound on a single scrap winder; otherwise, winders may be provided for each strip of scrap. In the prior art, when the tail end of the wide coil passes through the slitter, the trailing end of each of the scrap strips Sr no longer have any support and such strip falls haphazardly to a position beneath the floor line F, as suggested in the dot-dash lines in FIG. 1. It will be appreciated that a workman will have a difficult time in bringing the trailing end of the strap strip up to the leading end of the scrap removed from a subsequent coil, for the purpose of attaching such trailing and leading ends.

Figure 2:
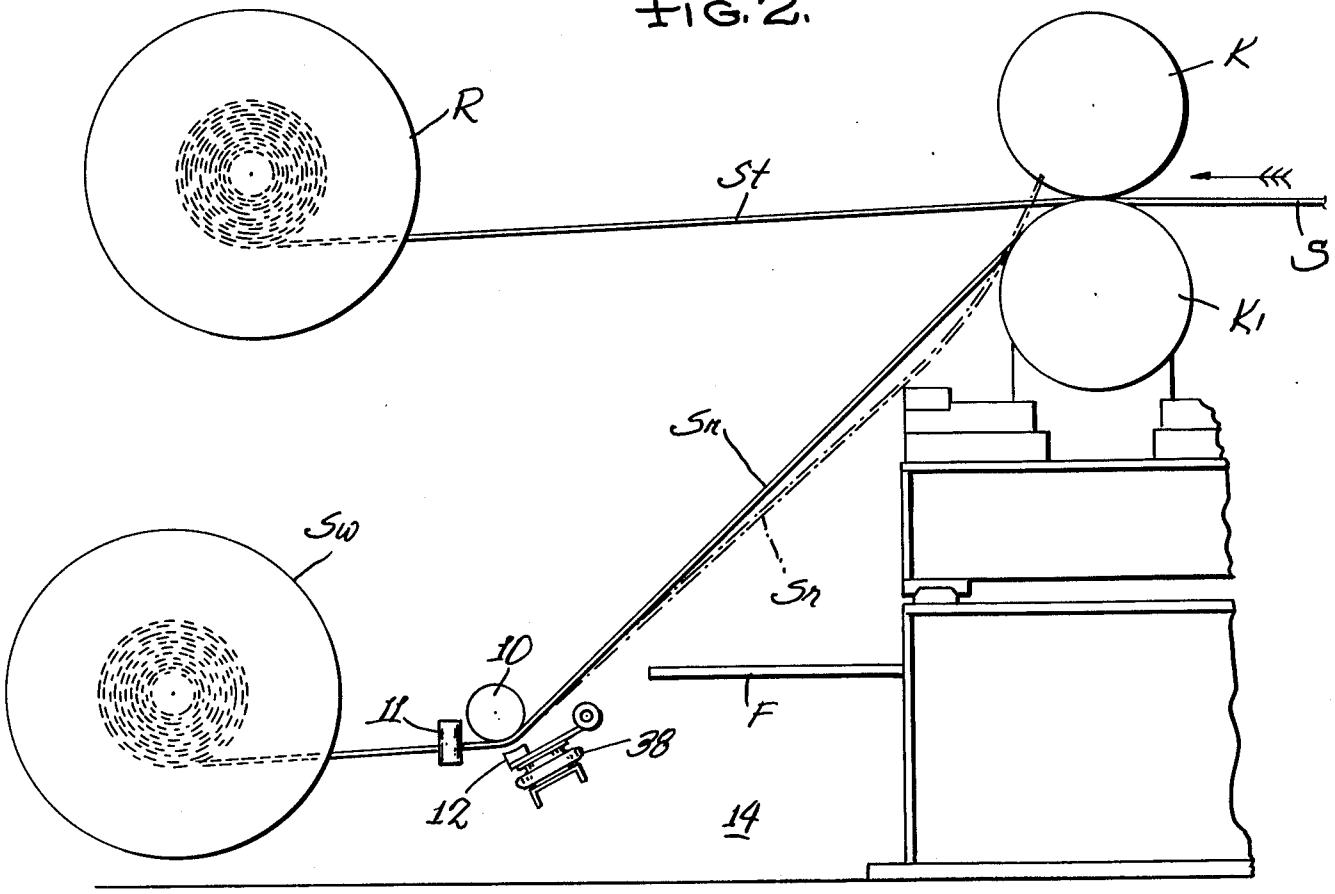
FIG. 2 is a schematic side elevational representation of a slitter line embodying my invention.
Figure 3:
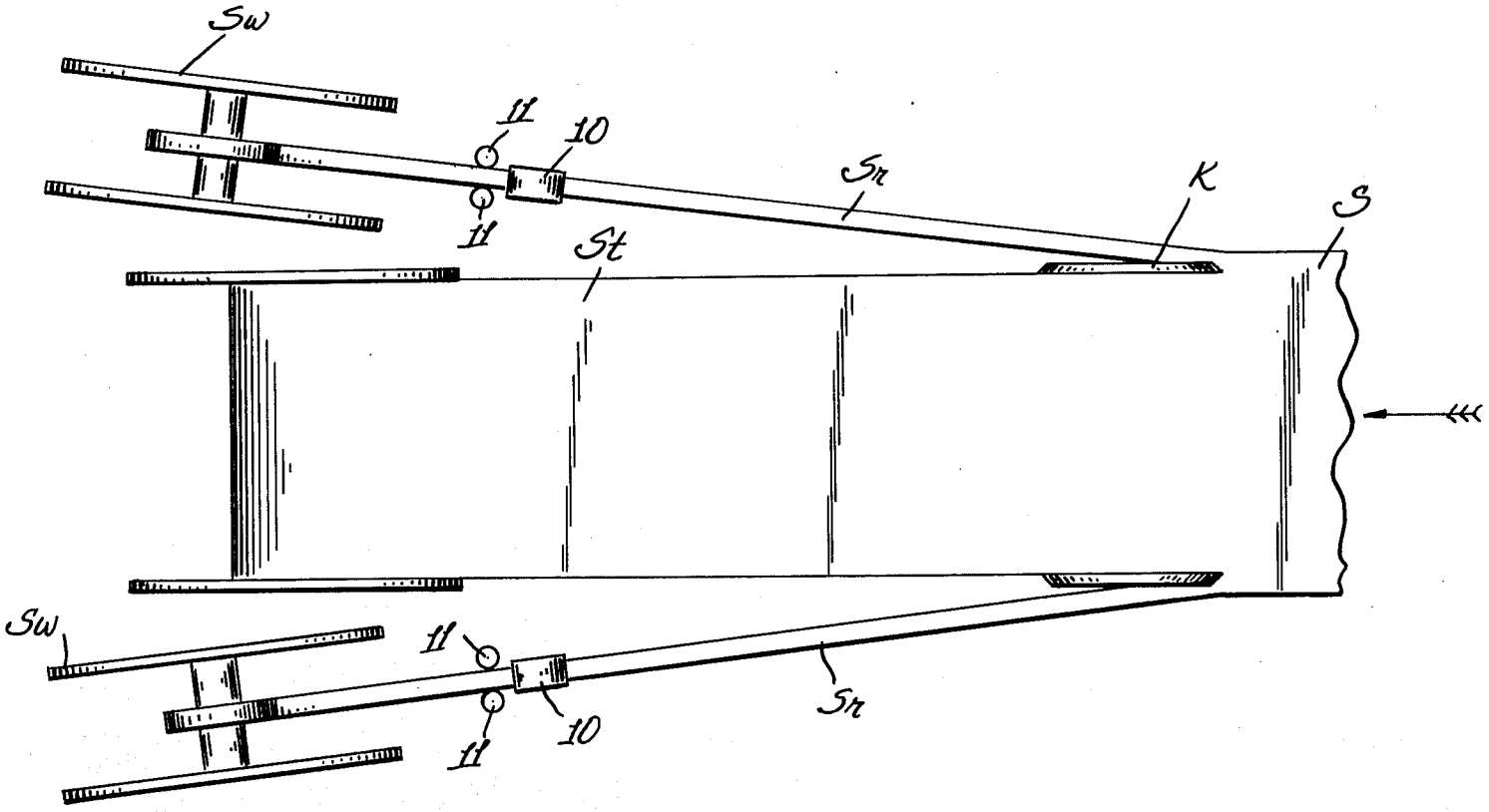
FIG. 3 is a schematic top plan view of the construction shown in FIG. 2, the scrap strips being shown diverging from the slit sheet for purpose of clarity of illustration.

My invention overcomes the difficulties above-noted and is diagrammatically illustrated in FIGS. 2 and 3. As before, the wide strip S is pulled through the slitter knives K, Kl and the trimmed strip St is wound on the mandrel of a recoiler R. The scrap strips Sr in this case pass around respective rolls 10, are guided laterally by pairs of spaced rolls 11—11 and then are wound on scrap winders Sw. FIG. 3 shows the scrap strips diverging in a direction away from the trimmed strip but this is only to show the various parts in uncovered relation. Actually, since the scrap strips Sr move downwardly from the trimmed strip St, there is sufficient clearance for the scrap strips to move parallel to the trimmed strip.

Just before the trailing end of the wide coil passes through the slitter knives, a shoe 12 is pressed against the roll 10 to clamp the scrap strip therebetween and thus halt any further longitudinal movement of the scrap strip. Then, when the trailing end of the wide coil finally passes through the slitter knives, the scrap strips will not fall into the pit 14 beneath the floor line F, but rather will be supported in an upright position by leaning against adjoining parts of the slitter housing, as shown in the dot-dash lines in FIG. 2, so that the ends of the scrap strips are positioned near the slitter rolls in handy position for connection to the leading end of the scrap strips from a subsequent wide coil, and ultimate stitch-weld connection thereto. The shoes 12 may thereafter be retracted from the respective rolls, and the slitter line restarted.

Figure 5:
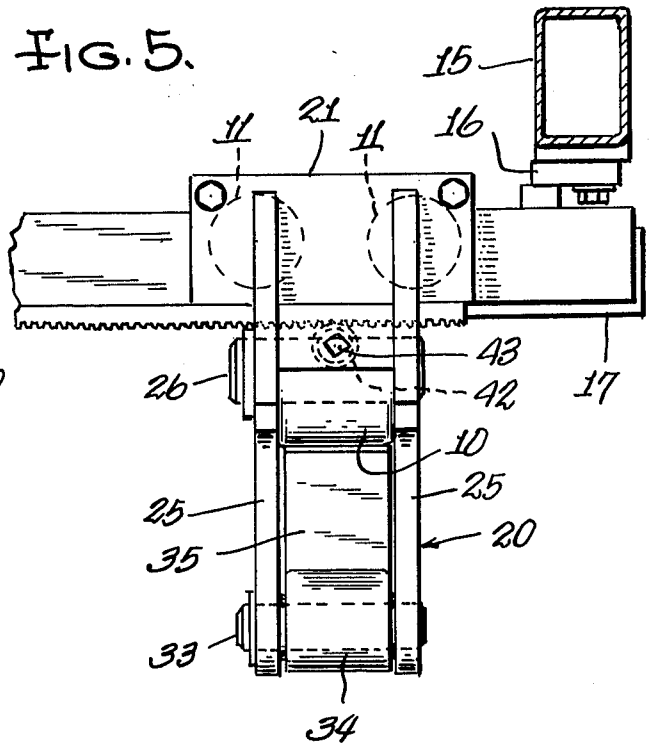
FIG. 5 is a fragmentary sectional view corresponding to the line 5—5 of FIG. 4, with the view turned to illustrate horizontal disposition of the structure.
Figure 4:
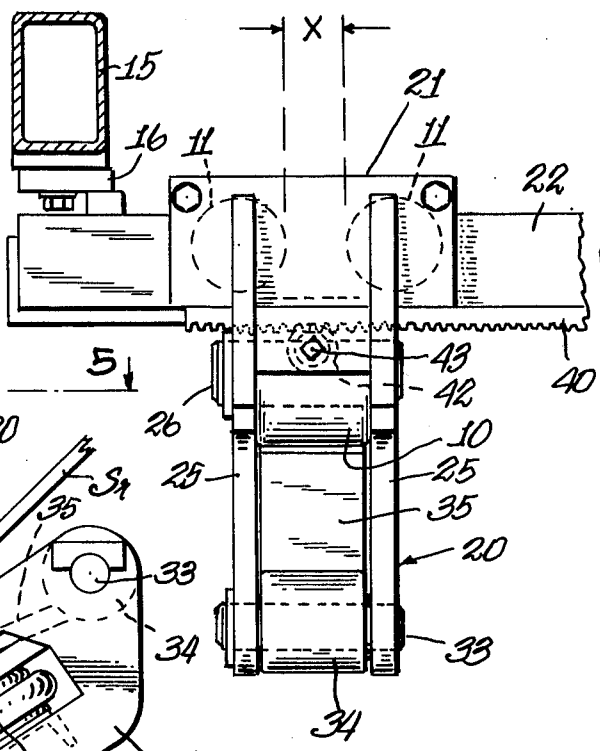
FIG. 4 is an enlarged, fragmentary side elevational view of apparatus designed to carry out my invention.
Figure 4:
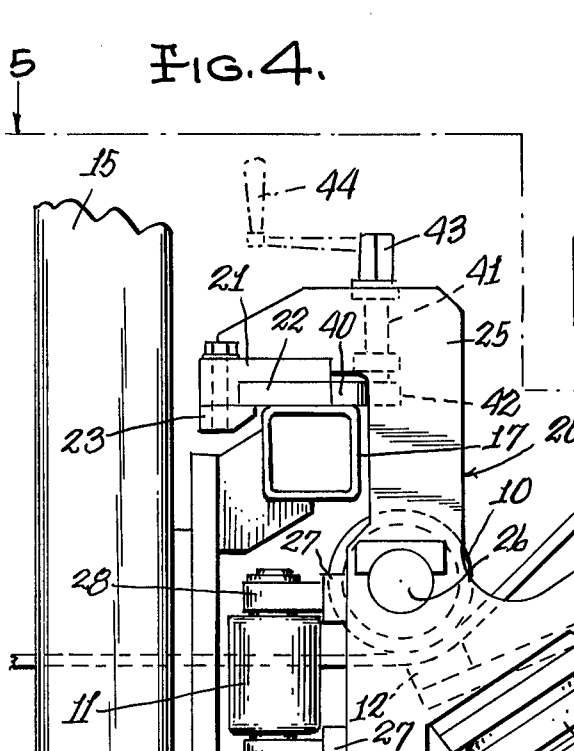

FIGS. 4 and 5 disclose a preferred form of structure for carrying out the improved method of my invention. A pair of vertical posts 15—15, which may be formed as steel tubing having a rectangular cross section, are firmly anchored to the factory foundation and/or fractory framework in spaced-apart relation, a spacing of about six feet (about twenty two centimeters) apart having been found suitable for most purposes.

A support pad 16 is secured to each post 15 to extend forwardly thereof, each pad supporting horizontally-extending upper and lower metal tubes 17 and 18. The posts, pads and tubes are preferably welded together to form a very rigid support structure. A pair of guide and clamp bodies 20 are mounted on the tubes 17 and 18 for horizontal movement therealong. Each body is a fabrication and includes a flat guide portion 21 having sliding engagement with a slide bar 22 which is fixed to the upper surface of the upper tube 17 and extends the length thereof. A gib 23 holds the guide portion 21 and slide 22 against vertical separation.

Each body 20 also includes a pair of spaced gusset plates 25—25 which are welded to the flat guide portion. The plates support a shaft 26 therebetween, on which is rotatably mounted a previously-mentioned roll 10. Each of the rolls 10 has a hardened portion to withstand wear caused by contact with the scrap strip Sr passing therearound.

Bars 27 are welded crosswise of the plates 25 to support bearings 28 in which the shafts of the spaced rolls 11—11 are supported. As shown in FIG. 5. the rolls are spaced a distance "x" which, for all practical purposes, is equal to three inches (about 7.6 centimeters). As will be evident from FIGS. 4 and 5, the scrap strip Sr extends downwardly from the slitter rolls and passes under the roll 10 and through the rolls 11—11 on its way to the scrap winder.

A flat slide bar 30 is fixed to the lower tube 18 and extends the length thereof. A slide plate 31 is welded across the gusset plates 25—25 and has a flat slide surface engaging a like surface on the bar 30. A gib 32 holds the bar 30 and slide plate 31 against lateral separation.

A shaft 33 is mounted between the outer extremities of the gusset plates. A boss 34 is rotatably mounted on the shaft 33 and a flat arm 35 is welded to and extends from the boss. As best seen in FIG. 4, the free end of the arm has a shoe 12 welded to it, the shoe having an arcuate surface complementary to the curvature of that portion of the scrap strip Sr which passes around the roll 10. The shoe 12 is also hardened to withstand wear.

Mounted on a platform 37 which is welded in position between the gusset plates 25—25 is an air bag 38 which is interposed between the platform 37 and the arm 35 and is operable, when air under pressure is admitted to the interior of the bag, to firmly press the shoe 12 against that portion of the scrap strip Sr at the roll 10, and thus clamp the strip against movement. The air bag may be of the type designated as Firestone Airstroke, Model 116. A valve (not shown) may be operated by a control on the operator's console, to cause air flow to the bag. The valve may also provide for exhaust of air from the bag, so that the latter will assume its unextended shape to cause withdrawal of the shoe 12 from engagement with the strip.

It will be appreciated that each of the bodies 20 may be slid lengthwise of the upper and lower tubes 17 and 18 to a selected horizontal position, the slide bars 22 and 30 providing for this movement. Secured to a longitudinal edge of the slide bar 22 is a gear rack 40 which extends for almost the entire length of the slide bar. A vertical shaft 41 is mounted in bearings carried by each body 20 and a gear 42 is fixed to the inner end of the shaft for meshing engagement with the rack 40. The outer end of the shaft 41 is squared, as shown at 43, to detachably receive a handle 44 (shown in dot-dash lines in FIG. 4).

To set up the apparatus for a slitting operation, a workman will move each of the bodies 20—20 horizontally along the tubes 17 and 18, to a position wherein the pass between the rolls 11—11 of each body will be lined up with the path of scrap movement. Movement of each body is effected by rotation of the handle 44 to rotate the gear 42 along the fixed rack 40. Wide strip S will then be fed into the slitter knives K, Kl. The leading end of the trimmed strip St will be secured to the arbor of the recoiler R and the leading ends of the scrap strips Sr will be threaded between a respective roll 10 and shoe 12, and then between the roll pairs 11—11 and thereafter attached to the arbor of the scrap winder.

When the trailing end of the wide strip nears the slitter knives, but has not yet passed through the knives, the machine operator actuates the valve control at his console to admit air under pressure to both air bags 38 so that the latter move their respective arms 35 to firmly press the shoes 12 against the scrap strip in the pass between the shoe and the roll 10 to firmly clamp that part of the scrap strip against linear movement. When the tail end of the wide strip S passes through the slitter knives, the tail end of both strips of scrap will remain in an upright position, such for example as shown in dot-dash lines in FIG. 2.

Thereafter, another coil of wide strip S may be placed on the uncoiler reel and threaded through the slitter knives. When sufficient strip has been trimmed by the slitter knives to provide a workable leading end of scrap strip, this leading end is clamped to the trailing end of the preceding scrap strip and the two ends are stitch-welded. Air is then exhausted from the air bags 38 to release the scrap strip and the slitting line is actuated for normal operation. It will be understood the leading end of the trimmed strip St will be attached to the arbor of the recoiler R (or in some cases to the trailing end of the strip already wound in the recoiler) before full slitting operation is resumed.

I claim:

1. In a slitter apparatus wherein a coil of metal to be slit is drawn from a payoff reel, the sheet metal running through slitter knives for trimming a longitudinal edge portion of the sheet, the trimmed sheet being wound on a recoiler and the longitudinal edge portion being considered as scrap strip which is wound on a scrap winder, the improvement comprising:

means forming a pass through which the scrap strip must pass from the slitter to the scrap winder, and means operable at a selected period of the slitting operation to clamp the scrap strip in said pass and hold it against linear movement.

2. The construction according to claim 1 wherein said operable means is actuated to clamp scrap strip in said pass at about the time the trailing end of the strip from said payoff reel passes through said slitter knives.

3. The construction according to claim 1 wherein scrap strip moves downwardly and away from said slitter knives on its way to said pass, and wherein said operable means is actuated to clamp scrap strip just before the trailing end of strip to be trimmed has passed completely through said slitter knives, whereby said scrap strip is held against longitudinal movement in an upright position with the trailing end of said scrap strip resulting when the strip has passed completely through the slitter knives disposed in position adjacent to said slitter knives and conveniently ready for connection to the leading end of scrap strip trimmed from sheet metal drawn off the payoff reel of a subsequent coil of sheet metal.

4. In a slitter apparatus wherein a coil of sheet metal to be slit is disposed on a payoff reel in position for the sheet metal to pass through slitter rolls for trimming a longitudinal edge portion of the sheet, the trimmed sheet being wound on a recoiler and the longitudinal edge portion being considered as scrap strip which is wound on a scrap winder, the improvement comprising:

a roll disposed between said slitter knives and said scrap winder around which said scrap strip must pass on its way to the scrap winder, and a shoe held against movement in a direction of the linear movement of said scrap strip, said shoe being arranged to clamp said scrap strip against said roll at a selected time to halt linear movement of said scrap strip.

5. The construction according to claim 4 wherein said shoe is carried on the free end of an arm which is pivoted to move said shoe toward and away from said roll, and an airbag adapted to receive air under pressure at a selected time and to expand and move said arm in a direction whereby said shoe clamps said scrap strip against said roll.

6. The construction according to claim 5 wherein said roll and shoe are disposed below said slitter knives and between the latter and said scrap winder, whereby said scrap strip is held to movement downwardly and away from said slitter knives on its way to said scrap winder, and including means operable just before the trailing end of the strip to be trimmed has passed completely through said slitter knives to cause air under pressure to be admitted to said air bag, whereby said scrap strip is held against linear movement and in an upright position with the trailing end of the scrap resulting when the strip to be trimmed has passed completely through said slitter knives disposed in position adjacent to said slitter knives and conveniently ready for connection to the leading end of scrap strip trimmed from a subsequent coil of sheet metal.

7. In a slitter apparatus wherein a coil of metal to be slit is drawn from a payoff reel, the sheet metal running through laterally-spaced pairs of slitter knives for trimming portions from opposite edges of the sheet, the trimmed sheet being wound on a recoiler and the trimmed opposite edge portions being considered as scrap strips which are wound on scrap winders, the improvement comprising:

a supporting frame at the exit end of the slitter knives, said frame having horizontally-disposed guide means, a pair of bodies slidable along said guide means, each body having spaced upright rolls, defining a pass through which a respective scrap strip passes and by which said scrap strip is guided to its scrap winder, each body having a horizontally-disposed metal roll around which a respective scrap strip passes on its way to its winder, said horizontally-disposed roll having a hardened peripheral surface, and a shoe adapted to clamp a scrap strip against a respective horizontally-disposed roll to halt linear movement of said scrap strip, said shoe having a hardened clamping surface adapted to press an adjoining portion of said scrap strip against the hardened peripheral surface of said horizontally-disposed roll.

8. The apparatus according to claim 7 wherein a fixed gear rack is carried by said supporting frame parallel to said guide means, each body having a gear meshing with said rack and adapted to be rotated to slide a body along said guide means.

9. The construction according to claim 7 wherein an air bag is adapted to move said shoe to clamping position, and further including means to admit air under pressure to said air bag to move said shoe to clamping position.

10. The construction according to claim 9 and further including an arm pivotally mounted on a respective body, each arm carrying a said shoe at its free end, said air bag being disposed between said arm and a bracket part of said body.

* * * * *